US011712063B2

(12) United States Patent
Garcia Garcia

(10) Patent No.: US 11,712,063 B2
(45) Date of Patent: Aug. 1, 2023

(54) SMOKING DEVICE

(71) Applicant: JT International S.A., Geneva (CH)

(72) Inventor: Eduardo José Garcia Garcia, Grand-Sacconex (CH)

(73) Assignee: JT International S.A.

( * ) Notice: Subject to any disclaimer, the term of this patent is extended or adjusted under 35 U.S.C. 154(b) by 461 days.

(21) Appl. No.: 16/761,661

(22) PCT Filed: Dec. 28, 2018

(86) PCT No.: PCT/EP2018/097081
§ 371 (c)(1),
(2) Date: May 5, 2020

(87) PCT Pub. No.: WO2019/129852
PCT Pub. Date: Jul. 4, 2019

(65) Prior Publication Data

US 2021/0112864 A1 Apr. 22, 2021

(30) Foreign Application Priority Data

Dec. 29, 2017 (EP) ..... 17211199

(51) Int. Cl.

| | |
|---|---|
| ***A24F 40/42*** | (2020.01) |
| ***A24F 1/26*** | (2006.01) |
| ***A24F 40/30*** | (2020.01) |
| *A24F 40/20* | (2020.01) |
| *A24F 40/46* | (2020.01) |

(52) U.S. Cl.
CPC ..... *A24F 40/42* (2020.01); *A24F 1/26* (2013.01); *A24F 40/30* (2020.01); *A24F 40/20* (2020.01); *A24F 40/46* (2020.01)

(58) Field of Classification Search
None
See application file for complete search history.

(56) References Cited

U.S. PATENT DOCUMENTS

| | | | | |
|---|---|---|---|---|
| 1,050,005 | A | 1/1913 | Crume | |
| 4,484,590 | A | 11/1984 | Singh | |
| 4,524,782 | A | 6/1985 | Chister | |
| 2014/0007891 | A1 | 1/2014 | Liu | |
| 2014/0014125 | A1 | 1/2014 | Fernando et al. | |
| 2017/0095623 | A1* | 4/2017 | Trzecieski | A61M 15/06 |

(Continued)

FOREIGN PATENT DOCUMENTS

| | | | |
|---|---|---|---|
| JP | S46035912 | Y1 | 12/1971 |
| JP | S51008388 | U | 1/1976 |

(Continued)

OTHER PUBLICATIONS

Search report from International Application No. PCT/EP2018/097081, dated Mar. 21, 2019.

*Primary Examiner* — James Harvey
(74) *Attorney, Agent, or Firm* — Lerner David LLP

(57) ABSTRACT

A smoking device includes a heating chamber for heating a tobacco consumable and a storage portion for storing the tobacco consumable. The storage portion is resealable. In some embodiments, the smoking device is elongate and the storage portion includes a resealable closure situated at or toward an end of the device. Also provided is a smoking kit including the smoking device and a tobacco consumable.

17 Claims, 5 Drawing Sheets

(56) References Cited

U.S. PATENT DOCUMENTS

| | | | | |
|---|---|---|---|---|
| 2020/0008469 | A1* | 1/2020 | Reevell | H05B 3/0014 |
| 2021/0112864 | A1* | 4/2021 | Garcia Garcia | A24F 40/42 |

FOREIGN PATENT DOCUMENTS

| | | | |
|---|---|---|---|
| JP | 2007014332 | A | 1/2007 |
| JP | 2010517586 | A | 5/2010 |
| JP | 2014500017 | A | 1/2014 |
| JP | 2015523077 | A | 8/2015 |
| WO | 2008098816 | A1 | 8/2008 |
| WO | 2017194762 | A1 | 11/2017 |
| WO | 2017203515 | A1 | 11/2017 |

* cited by examiner

SMOKING DEVICE

CROSS-REFERENCE TO RELATED APPLICATIONS

The present application is a national phase entry under 35 U.S.C. § 371 of International Application No. PCT/EP2018/097081, filed Dec. 28, 2018, published in English, which claims priority to European Application No. 17211199.9 filed Dec. 29, 2017, the disclosures of which are incorporated herein by reference.

FIELD OF INVENTION

The present invention relates to a smoking device. In particular, the present invention relates to a smoking device for heating a tobacco consumable to release an inhalable vapour, the smoking device providing storage for additional tobacco consumable.

BACKGROUND

Smoking devices such as electronic cigarettes which generate a vapour from a liquid are relatively well known and are becoming increasingly popular. Another type of smoking device utilises controlled-temperature heating whereby a tobacco consumable is heated to release a vapour but without increasing the heating temperature to a level at which the material burns. Such smoking devices have the advantage of generating an inhalable vapour without requiring burning of the tobacco consumable. In these known smoking devices, only a specified amount of a tobacco consumable is heated at any one time such that the smoking experience can be tailored to suit the user.

Smoking devices are generally utilised by a user at several time intervals throughout a day. The smoking devices must therefore be suitable to provide the user with sufficient tobacco consumable to enable effective operation of the device. In particular, the user does not want to run out of tobacco consumable. Many of the known smoking devices contain limited tobacco consumable and may require a user to separately carry additional tobacco consumable or containers thereof, such as capsules, in order to replenish the smoking device. Such tobacco consumable and containers thereof are generally not reusable, suitable only to be used with the smoking device in a single instance. There therefore exists a need for a smoking device configured to heat, without burning, a tobacco consumable, the smoking device additionally enabling a user to store additional tobacco consumable for replenishing the smoking device.

SUMMARY OF THE INVENTION

It is an object of the aspects of the present invention to provide a solution to the above mentioned or other problems.

According to a first aspect of the present invention there is provided a smoking device comprising a heating chamber for heating a tobacco consumable and a storage portion for storing the tobacco consumable, wherein the storage portion is resealable.

The smoking device according to the present invention is advantageously configured to heat, without burning, a tobacco consumable, in addition to enabling a user to store additional tobacco consumable for replenishing the smoking device. The user is thus able to replenish the tobacco consumable used in the device without having to separately carry additional tobacco consumable or containers thereof, such as capsules. The resealable nature of the storage portion enables the storage portion to be reusable and furthermore, enables the quality of the additional tobacco consumable stored with the device to be maintained.

The smoking device may be elongate. The smoking device may comprise a longitudinal direction, having a longitudinal axis along its length. The smoking device may have a first end and a second end. The smoking device may have a mouthpiece for inhalation situated at or toward the second end. The smoking device may have any suitable dimensions. Preferably, the smoking device is configured to fit into the palm of a hand of the user.

The storage portion of the smoking device may be elongate. The storage portion may comprise a longitudinal direction, having a longitudinal axis along its length. The storage portion of the smoking device may comprise a resealable closure situated at or toward an end of the smoking device, preferably the first end of the device. The resealable closure may have an open and a closed position. The resealable closure may be detachable from the storage portion. Alternatively, the resealable closure may be connected to the storage portion. The resealable closure may be rotatably connected to the storage portion such that the resealable closure has an open and a closed position. By the term "rotatably connected" as used herein, is meant that the resealable closure is connected to the storage portion by a pivot point. It will be understood by a skilled person that the resealable closure may rotate about the pivot point between the open and closed positions. For example, the resealable closure may rotate about the pivot point between the open and closed position in the longitudinal direction of the device, such as a hinged lid or may rotate between the open and closed position laterally from the pivot point. The resealable closure may be slidably connected to the storage portion such that the resealable closure has an open and a closed position. By the term "slidably connected" as used herein, is meant that the resealable closure is connected to the storage portion via an engagement portion such that the resealable closure may slide along the engagement portion between the open and closed positions. It will be further appreciated that resealable closures detachable from the storage portion may in fact remain connected to the smoking device via a linking portion such as a cord, line or strip of material to prevent the resealable closures completely detaching from the storage portion of the smoking device. The open position of the resealable closure is intended to refer to the position of the resealable closure when the storage portion and contents thereof are accessible to a user and the closed position of the resealable closure is intended to refer to the position of the resealable closure when the storage portion is sealed. Examples of suitable resealable closures include detachable closures such as stoppers, bungs, caps including screw caps; rotatable closures such as hinged lids and laterally rotating lids or panels and slidable closures such as sliding lids or panels. Preferably, the detachable closure is a hinged lid. The resealable closure may further comprise a seal associated therewith, operable to seal the storage portion when the resealable closure is in the closed position. The seal may be formed from any suitable material. Examples of suitable materials for the seal include resilient materials such as rubber, plastic, metal and combinations thereof. The resealable closure of the storage portion enables a user to access the storage portion of the smoking device to remove or refill tobacco consumable, whilst maintaining the quality of the tobacco consumable stored therein. It will be understood by a skilled person that the tobacco consumable can thus be stored in the storage portion in an airtight manner. By the term "airtight" as used herein is meant that the change in moisture level of the tobacco consumable in the storage portion is less than 20%, such as less than 10% and preferably, less than 5% of the original value after exposure to 180 days with a room temperature of 22° C. and room relative humidity of 60%.

The storage portion of the smoking device may comprise a separator operable to partition the storage portion into at least a first storage portion and a second storage portion, at least one of the first and second storage portions comprising a resealable closure. Both of the at least first and second storage portions may comprise a resealable closure. When the at least first and second storage portions both comprise a resealable closure, the resealable closure of the at least first storage portion may be at or toward a first end of the smoking device and the resealable closure of the second storage portion may be at or toward a second end of the smoking device. The resealable closures of the at least first and second storage portions may each have an open and a closed position as described above in relation to the resealable closure of the storage portion. The resealable closures of the at least first and second storage portions may each further comprise a seal associated therewith as described above in relation to the resealable closure of the storage portion. The at least first and second storage portions provide a user with different storage options for tobacco consumable. For example, a user may store different varieties of tobacco consumable in each of the at least first and second storage portions or use the first or second storage portion to store any used tobacco consumable, whilst storing fresh tobacco consumable in the other storage portion. The storage portion may be partitioned by the separator such that each of the at least first and second storage portions has the same volume as the other and thus, is operable to receive the same capacity of tobacco consumable. Alternatively, the at least first and second storage portions may be partitioned so as to have differing volumes and differing capacity for tobacco consumable. The separator of the storage portion may be formed from any suitable material. The separator of the storage portion may be moveable to alter the volume of the at least first and second storage portions. The separator of the storage portion may comprise a handle accessible from the exterior of the smoking device to enable a user to move the separator. When the storage portion is elongate, the separator is moveable in the longitudinal direction of the storage portion to alter the volume of the at least first and second storage portions.

The separator may be generally perpendicular to the longitudinal direction of the storage portion. The separator being movable enables the user of the smoking device to tailor the volume and thus, storage capacity of the at least first and second storage portions.

The heating chamber of the smoking device may comprise an opening and a closure associated therewith. It will be understood by a person skilled in the art that the opening and closure associated therewith may enable air to flow through the heating chamber, or alternatively, the heating chamber may additionally comprise other openings to enable air to flow through the heating chamber and facilitate the production of vapour and its movement towards the mouthpiece upon inhalation of the user. The closure associated with the opening of the heating chamber may have an open and a closed position. It will be appreciated that the closure associated with the opening of the heating chamber may enable air to flow through the heating chamber when the closure is in the closed position during use of the smoking device. The open position of the closure of the heating chamber is intended to refer to the position of the closure when the heating chamber and contents thereof are accessible to the user and the closed position of the closure of the heating chamber is intended to refer to the position of the closure when the heating chamber and contents thereof are no longer accessible to a user. It will be appreciated that when the closure of the heating chamber is in the open position and the heating chamber and contents thereof are accessible to the user, the storage portion of the smoking device is sealed when the resealable closure of the storage portion is in the closed position. The closure of the heating chamber may be detachable from the smoking device. Alternatively, the closure of the heating chamber may be connected to the smoking device. Examples of suitable closures include detachable closures such as stoppers, bungs, caps including screw caps; rotatable closures such as hinged lids and laterally rotating lids or panels and slidable closures such as sliding lids or panels. Preferably, the detachable closure is a hinged lid. The closure of the heating chamber may be resealable. It will be appreciated that when the closure of the heating chamber is resealable, the closed position of the closure of the heating chamber is intended to refer to the position of the closure when the heating chamber is sealed. When the closure of the heating chamber is resealable, the closure may be as described above in relation to the resealable closure of the storage portion of the smoking device. It will be appreciated that the closure of the heating chamber will be heat-resistant. The opening of the heating chamber and closure associated therewith enable a user to fill the heating chamber with tobacco consumable and prevent the tobacco consumable from falling out of the heating chamber of the smoking device. The opening and closure associated therewith may be positioned at or toward a first end of the device. The opening and closure associated therewith may be positioned at or toward the same end of the device as the resealable closure of the storage portion. When the storage portion is partitioned into at least a first storage portion and a second storage portion, the opening and closure associated therewith may be positioned at or toward the same end of the device as the resealable closure of the first storage portion. The user can thus easily transfer tobacco consumable from the storage portion of the smoking device to the heating chamber.

The storage portion of the smoking device may be detachable from the smoking device. The storage portion and smoking device may thus comprise a connecting mechanism to facilitate the attachment and detachment of the storage portion. Examples of suitable connecting mechanisms include fastenings such as magnets, latches, clasps, and hook-and-eye closures.

The capacity of the storage portion may be smaller than, the same as or greater than that of the heating chamber of the smoking device. Preferably, the capacity of the storage portion is such that the user can use the device throughout the whole day without having to replenish the tobacco consumable in the storage portion. By the term "capacity" as used herein, is meant the maximum amount of tobacco consumable that can fill the volume of the storage portion. Preferably, the capacity of the storage portion is the same or greater than that of the heating chamber of the smoking device, most preferably, greater than the capacity of the heating chamber.

A user may transfer tobacco consumable from the storage portion of the smoking device to the heating chamber via the resealable closure of the storage portion and the opening of the heating chamber. A user can thus control the amount of tobacco consumable being introduced into the heating chamber according to personal preference. The smoking device may further provide the user with an indication as to when transfer of tobacco consumable from the storage portion to the heating chamber is required. Examples of such indications include visual indications such as a constant or flashing LED light and physical indications such as vibration or pulsing of the smoking device. Alternatively, the smoking device may comprise a transfer mechanism to transfer, in use, tobacco consumable from the storage portion of the smoking device to the heating chamber. Examples of transfer mechanisms include a mechanical network of moveable components, such as flat panels, that transfer a portion of the tobacco consumable, the portion corresponding to the capacity of the heating chamber, from the storage portion to the heating chamber. The transfer mechanism, such as the mechanical network of moveable components may be activated by the user of the device via a trigger such as a button or switch. It will be appreciated that smoking devices comprising transfer mechanisms may further provide the user with an indication as to when transfer of tobacco consumable from the storage portion to the heating chamber is required. Examples of such indications include visual indications such as a constant or flashing LED light and physical indications such as vibration or pulsing of the smoking device. Alternatively, the transfer mechanism may, in use, transfer the tobacco consumable from the storage portion to the heating chamber upon measurement of a predetermined parameter associated with the smoking device. Examples of such predetermined parameters include a predetermined heating time, a predetermined number of inhalations (puffs) taken by a user and a predetermined time since the previous refill. For example, transfer mechanisms may transfer the tobacco consumable from the storage portion to the heating chamber after 5 to 7 minutes of heating, such as after 5.5 to 6.5 minutes of heating, preferably after 6 minutes of heating, after 8 to 12 inhalations (puffs) taken by the user, such as after 9 to 11 inhalations (puffs) taken by the user, preferably 10 inhalations (puffs) taken by the user, within 0.5 hours to 2 hours of the previous refill, such as within 0.5 hours to 1.5 hours of the previous refill, preferably within 1 hour of the previous refill or within 2 to 4 days of the previous refill, such as within 2.5 to 3.5 days of the previous refill, preferably within 3 days of the previous refill.

Tobacco consumable for use in the smoking device may be provided in any suitable form. Examples of suitable forms of tobacco consumable include those such as capsules, sticks, tobacco tablets, free-tobacco, reconstituted tobacco sheets and tobacco foam.

According to a second aspect of the present invention there is provided a smoking kit comprising a smoking device according to the first aspect of the present invention and a tobacco consumable in the storage portion.

All of the features contained herein may be combined with any of the above aspects and in any combination.

BRIEF DESCRIPTION OF THE DRAWINGS

For a better understanding of the invention and to show how embodiments of the same may be carried into effect, reference will now be made, by way of example, to the accompanying drawings in which.

DETAILED DESCRIPTION

Figure 1:
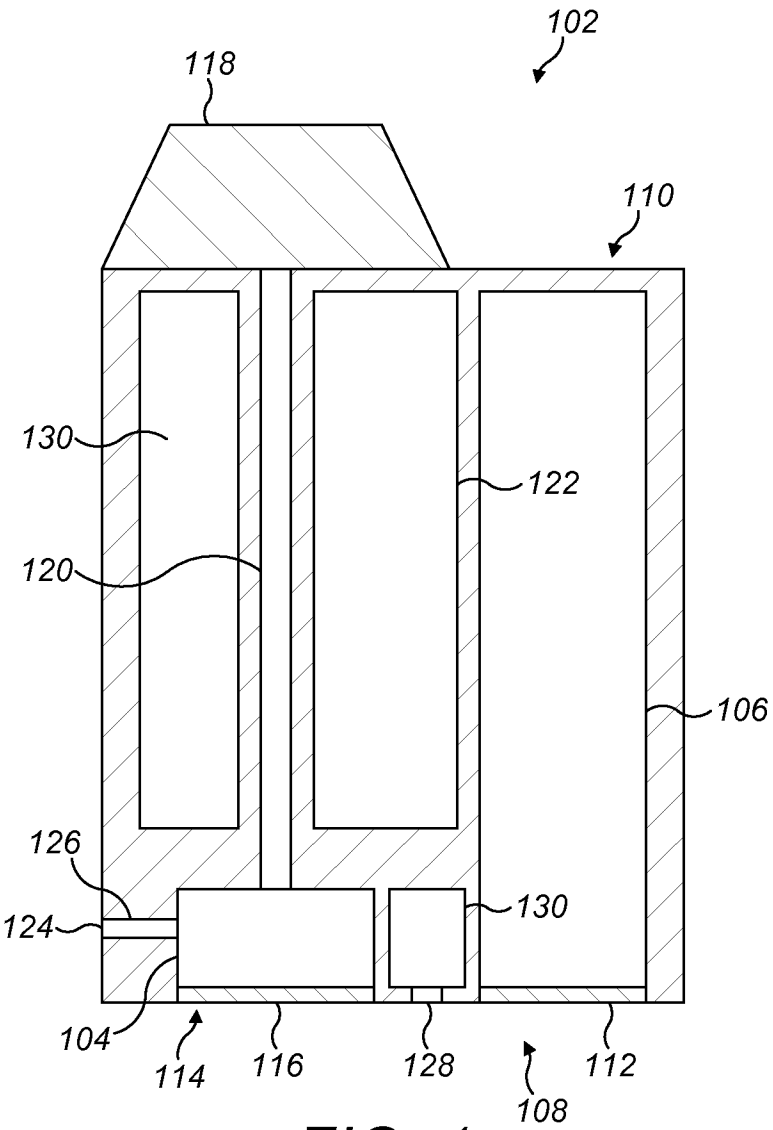
FIG. 1 shows a cross-sectional view of a smoking device according to an embodiment of the first aspect of the present invention.

Referring to FIG. 1, there is provided a smoking device 102 according to an embodiment of the first aspect of the present invention having a heating chamber 104 and a storage portion 106. The smoking device 102 is elongate and has a longitudinal direction, having a longitudinal axis along its length. The smoking device 102 has a first end 108 and a second end 110. The storage portion 106 is elongate and has a longitudinal direction, having a longitudinal axis along its length. The storage portion 106 has a resealable closure 112 at the first end 108 of the smoking device 102. The resealable closure 112 of FIG. 1 is a hinged lid. The resealable closure 112 has a seal of resilient rubber material (not shown). In FIG. 1, the resealable closure 112 is in the closed position and seals the storage portion 106 in an airtight manner. The capacity of the storage portion 106 is greater than that of the heating chamber 104.

The heating chamber 104 of the smoking device 102 has an opening 114 and a closure 116 associated therewith. The opening 114 and closure 116 associated therewith are situated at the first end 108 of the smoking device 102. The opening 114 and closure 116 associated therewith are at the same end 108 of the smoking device 102 as the resealable closure 112 of the storage portion 106. The closure 116 associated with the opening 114 is a hinged lid. In FIG. 1, the closure 116 is in the closed position.

The smoking device 102 comprises a mouthpiece 118 positioned at the second end 110 of the smoking device 102 and connected to heating chamber 104 via a vapour passageway 120. In use, a user inhales through the mouthpiece 118 activating a heater (not shown) to draw vapour, generated in the chamber 104 through the mouthpiece 118 for inhalation.

The smoking device 102 has a heater (not shown) associated with the heating chamber 104 and configured to heat tobacco consumable held in the chamber 104. The heater is preferably configured to heat the tobacco consumable in the heating chamber 104 to a temperature sufficient to release vapour but is restricted from exceeding a temperature at which the tobacco consumable burns. In FIG. 1 the heating chamber 104 is formed of heating plates (not shown), substantially surrounding the chamber 104 on all sides other than the side interfacing with the vapour passageway 120. This arrangement allows for heating of a large proportion of the surface area of the chamber 104, facilitating a constant uniform heating and thus aiding in maintaining the controlled temperature in the chamber 104 necessary to heat the tobacco consumable contained therein to a specific temperature without burning. It will be appreciated that the chamber 104 may be heated using alternate heating methods, for example, the chamber 104 may be formed from a conductive shell which is heated to provide the required uniform heating. In FIG. 1, the heater (not shown) is an electric heater powered by a battery 122 disposed in another portion of the device 102. The heater may be actuated by a user implemented heating button (not shown) or by other trigger mechanisms, such as a flow sensor actuated by a user inhaling at the mouthpiece 118 of the smoking device 102. When the heater is actuated, the temperature of the heating plates (not shown) rises to a level sufficient to heat the tobacco consumable within the chamber 104 to a level whereby it releases vapour without burning. Upon inhalation at the mouthpiece 118, ambient air enters the device 102 through an air inlet 124 and air inlet passageway 126 and closure 116 into the heating chamber 104. It will be appreciated by a person skilled in the art that there may be multiple air inlets 124 and air passageways 126 in different configurations depending on the overall configuration of the smoking device 102. It will further be appreciated by a person skilled in the art that air may also be drawn into the smoking device 102 and flow directly into and through the heating chamber 104 through the closure 116, such that air inlets and air inlet passageways are optional features of the smoking device 102. The ambient air mixes the vapour generated from the tobacco consumable in the heating chamber 104 and this mixture travels out of the chamber 104 along the vapour passageway 120 for inhalation by the user through the mouthpiece 118. The vapour exiting the device 102 via the mouthpiece 118 is therefore a combination of vapour generator in heating of the tobacco consumable, mixed with ambient air introduced into the device 102 through the air inlet 124.

In FIG. 1, the battery 122 of the smoking device 102 is rechargeable via a charging port 128 situated at the first end 108 of the smoking device 102. It will be appreciated that the charging port 128 may be situated at other positions on the exterior of the smoking device 102. The overall control of the smoking device 102 is facilitated by the control circuity 130. It will be appreciated that the control circuitry may be positioned in the device in any suitable configuration to facilitate the overall control of the device 102.

Figure 2:
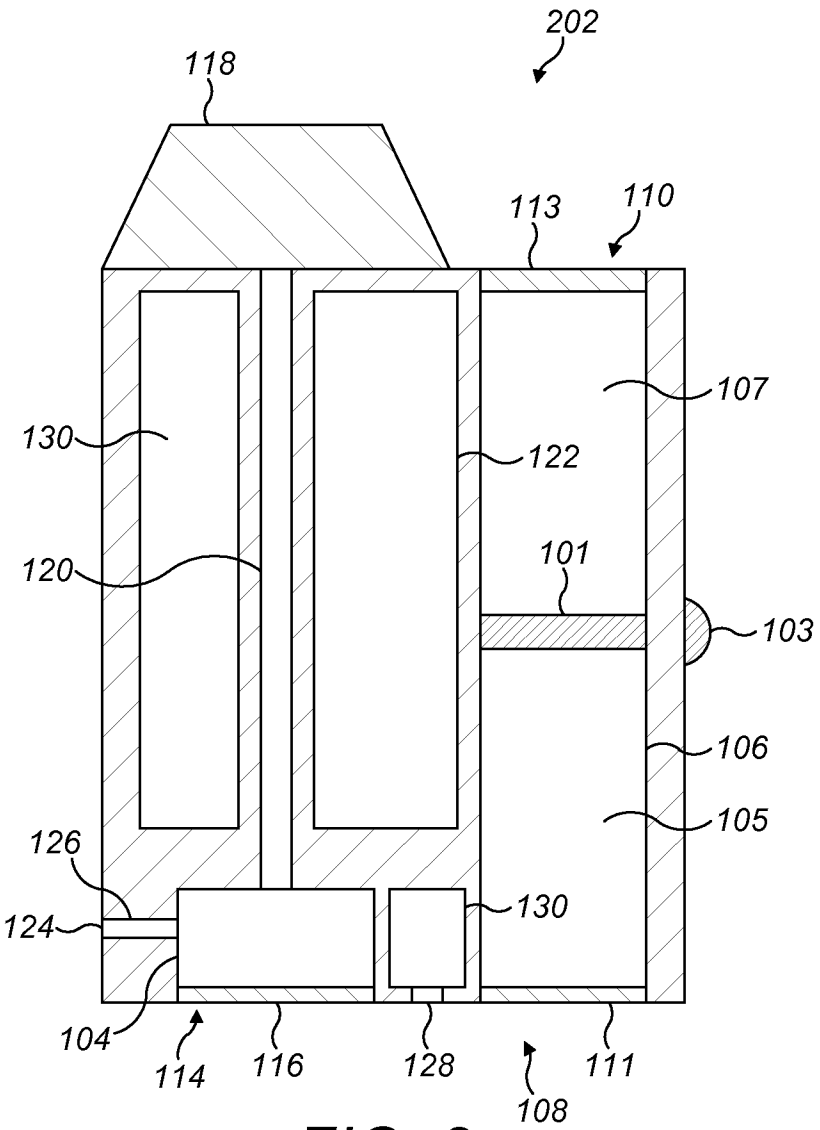
FIG. 2 shows a cross-sectional view of a smoking device according to an embodiment of the first aspect of the present invention, having a separator in the storage portion.

FIG. 2 illustrates a smoking device 202 according to an embodiment of the first aspect of the present invention, having a separator 101 partitioning the storage portion 106 into a first storage portion 105 and a second storage portion 107. The smoking device 202 of FIG. 2 has been adapted with respect to the device 102 of FIG. 1. As shown in FIG. 2, the first storage portion 105 and the second storage portion 107 may have the same volume and thus, the same storage capacity. It will however be appreciated by a skilled person that the volume and thus, the storage capacity of the first storage portion 105 and the second storage portion 107 may differ when the separator 101 is placed at a different position along the longitudinal direction of the storage portion 106. The separator 101 is moveable in the longitudinal direction of the storage portion 106 to alter the volume of the first storage portion 105 and second storage portion 107. The separator 101 has a handle 103 accessible from the exterior of the smoking device 202 to enable the user to easily move the separator 103 in the longitudinal direction of the storage portion 106.

The first storage portion 105 has a resealable closure 111 at the first end 108 of the smoking device 202 and the second storage portion 107 has a resealable closure 113 at the second end 110 of the device 202. The resealable closures 111 and 113 are hinged lids. The resealable closures 111 and 113 have a seal of resilient rubber material (not shown). In FIG. 2, the resealable closures 111 and 113 are each in the closed position, respectively sealing the first storage portion 105 and the second storage portion 107 in an airtight manner. The resealable closure 111 of the first storage portion 105 is at the same end 108 of the smoking device 202 as the opening 114 and closure 116 associated therewith of the heating chamber 104.

It will be appreciated that the operation of the smoking device of FIG. 2 is as described above in relation to FIG. 1. It will be further appreciated that where the reference numerals in FIG. 2 are the same as those in FIG. 1, the reference numerals refer to the same features of the smoking device.

Figure 3:
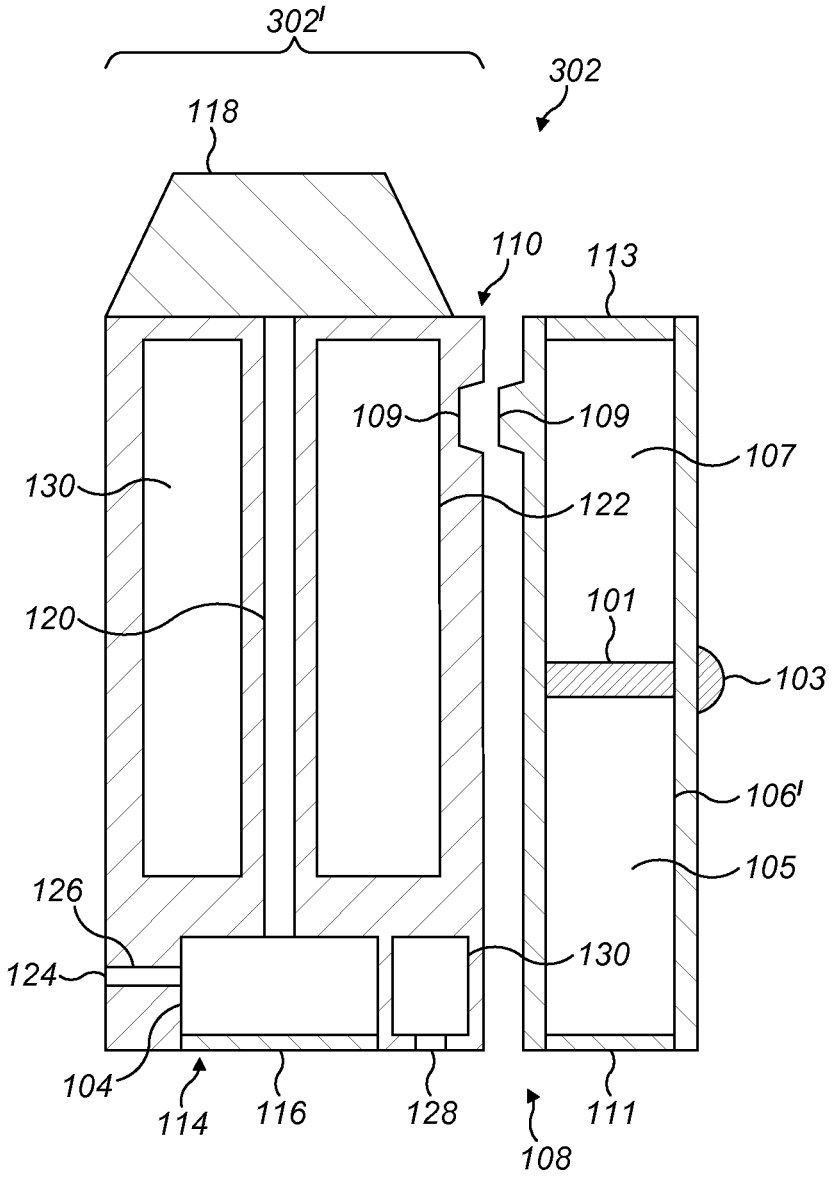
FIG. 3 shows a cross-sectional view of a smoking device according to an embodiment of the first aspect of the present invention, having a separator in the storage portion and a storage portion that is detachable from the smoking device.

Referring to FIG. 3, there is provided a smoking device 302 according to an embodiment of the first aspect of the present invention, having a detachable storage portion 106'. The smoking device 302 of FIG. 3 is adapted from the smoking devices 102 and 202 of FIGS. 1 and 2. The detachable storage portion 106' is shown in the detached position and is detachable and reattachable to the modified smoking device 302' via a connecting mechanism 109. In FIG. 3, the connecting mechanism is a pair of magnets, each of the detachable storage portion 106' and modified smoking device 302' comprising a magnet thereon. It will be appreciated that the connecting mechanism 109 may also be other fastenings such as latches, clasps, and hook-and-eye closures.

It will be appreciated that the operation of the smoking device of FIG. 3 is as described above in relation to FIGS. 1 and 2. It will be further appreciated that where the reference numerals in FIG. 3 are the same as those used in FIGS. 1 and 2, the reference numerals refer to the same features of the smoking device.

In FIGS. 1 to 3, it will be appreciated that tobacco consumable may be transferred from the storage portion 106 in FIG. 1 and either of the first storage portion and second storage portions in FIGS. 2 and 3 to the heating chamber 104 by the user, using the resealable closures 112 of the storage portion 106, the resealable closure 111 of the first storage portion 105 or the resealable closure 113 of the second storage portion 107 and the opening 114 and closure 116 associated therewith of the heating chamber 104.

Figure 4:
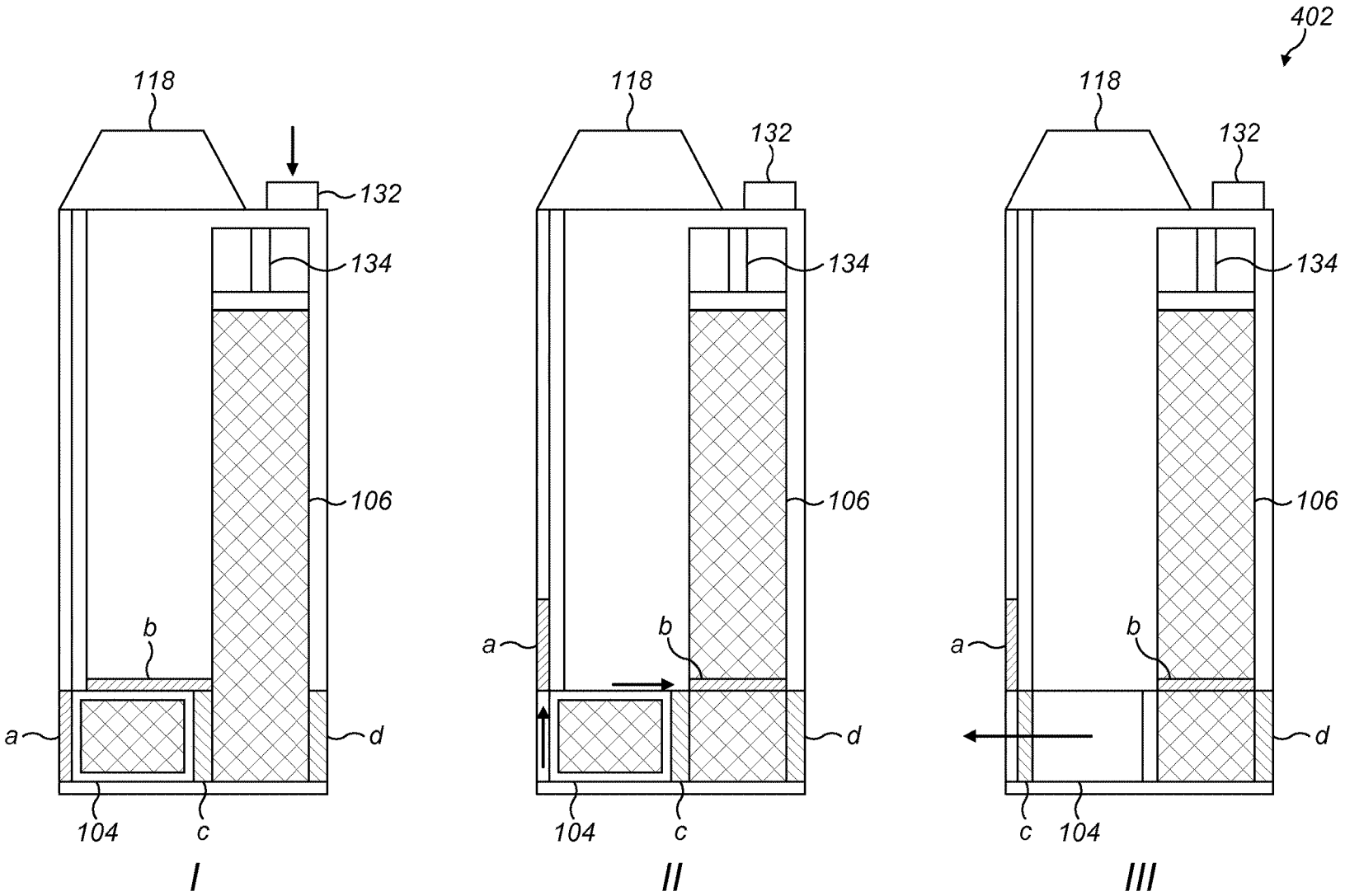
FIG. 4 shows a number of cross-sectional views of a smoking device according to an embodiment of the first aspect of the present invention, depicting different stages in the transfer of tobacco consumable from the storage portion of the smoking device to the heating chamber by a transfer mechanism.
Figure 4:
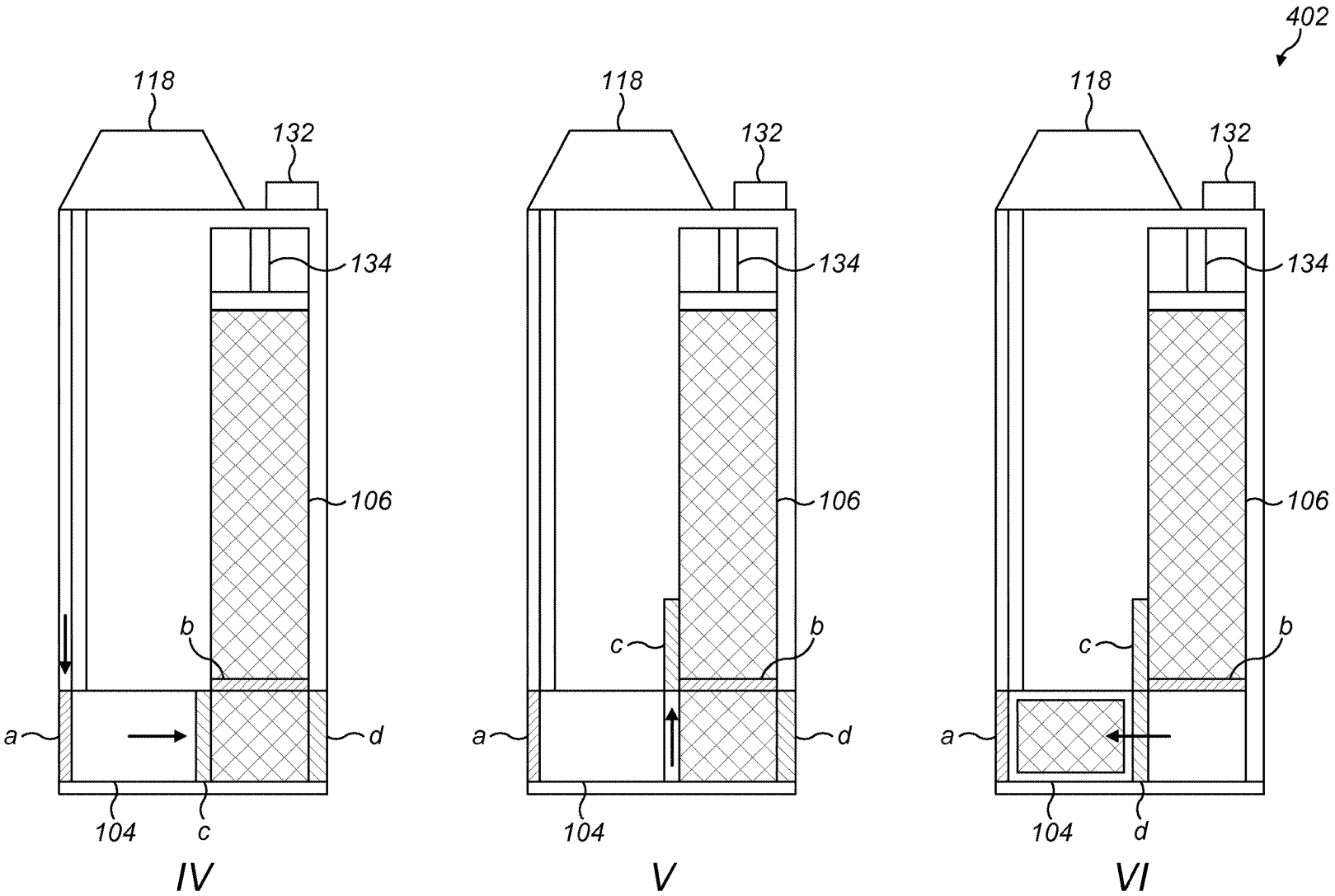
Figure 4:
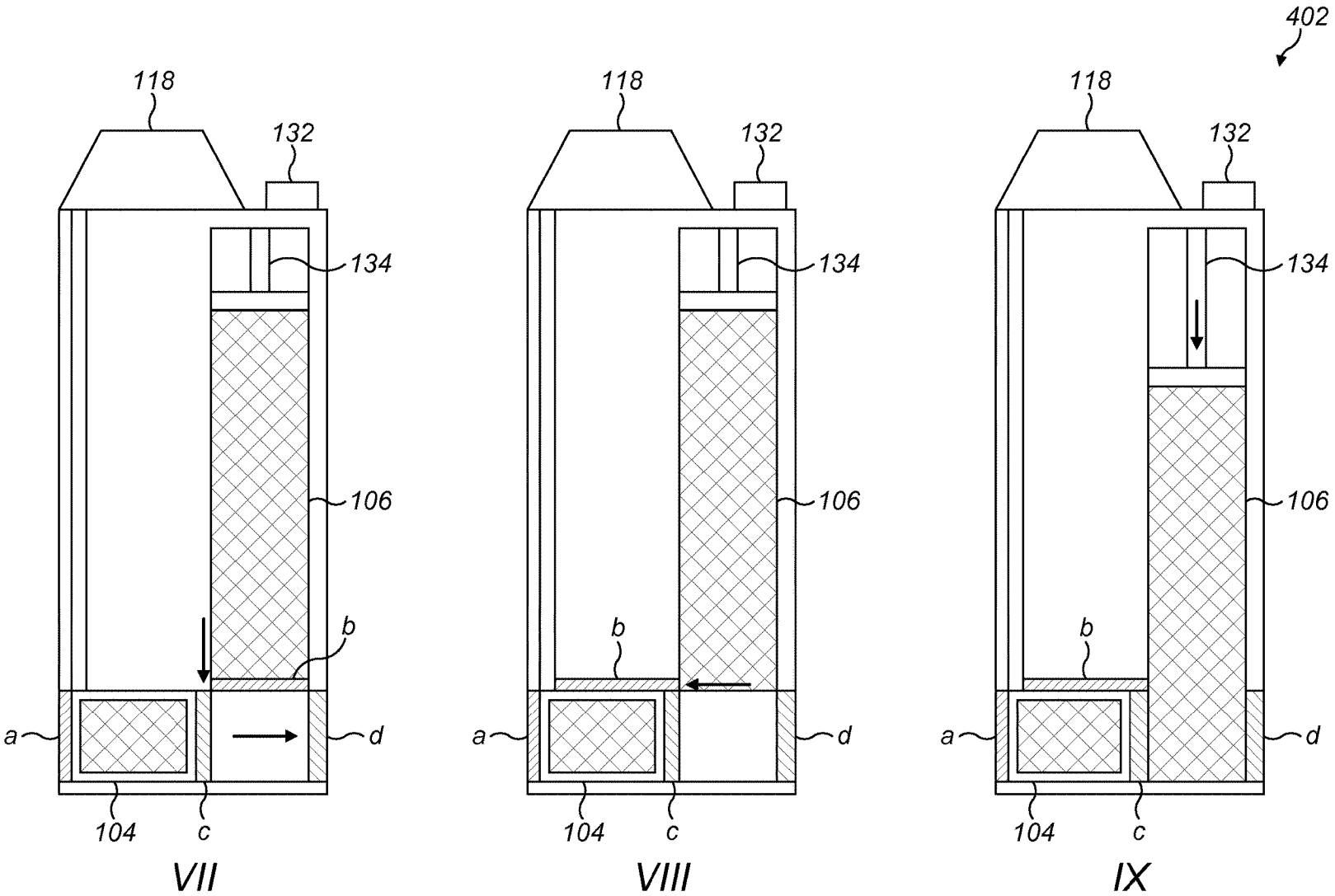

Alternatively, the tobacco consumable may comprise a transfer mechanism to transfer, in use, tobacco consumable from the storage portion of the smoking device to the heating chamber. FIG. 4 depicts a smoking device 402 according to an embodiment of the first aspect of the present invention, having a transfer mechanism that facilitates the transfer of tobacco consumable from the storage portion 106 to the heating chamber 104. FIG. 4 shows the smoking device 402 at different stages I to IX of the transfer of tobacco consumable. The smoking device 402 of FIG. 4 has been adapted with respect to the smoking devices 102, 202, 302 of FIGS. 1 to 3 and depicts a simplified version of those smoking devices 102, 202, 302. In FIG. 4, features of the smoking device 402, for example the electric circuitry, vapour passageway, battery, resealable closures, opening of the heating chamber and air inlets are not shown for ease of interpretation and understanding of FIG. 4 in relation to the transfer of tobacco consumable. It will be appreciated that these features and indeed, all of those discussed in relation to FIGS. 1 to 3, may be present in the smoking device depicted in FIG. 4.

It will be appreciated that there are a variety of different transfer mechanisms that may be employed to transfer tobacco consumable from the storage portion of the smoking device to the heating chamber. In FIG. 4, the transfer mechanism is a mechanical network of moveable components, the moveable components being flat panels. As depicted in stage I of FIG. 4, the mechanical framework of moveable components is actuated by the user pressing a trigger. In FIG. 4, this trigger is a button 132. Upon activation of the mechanical framework of moveable components and as shown in stage II, panel a and panel b move position within the smoking device 402. Panel a slides vertically upwards in the device 402 and panel b slides laterally across the device 402. The movement of panel a creates an opening in the heating chamber 104 to the exterior and the movement of panel b sections off a portion of tobacco consumable in the storage portion, the portion corresponding to the capacity of the heating chamber. At stage III, any used tobacco consumable in the heating chamber 104 is emptied from the chamber 104 via the opening created in the heating chamber 104 by panel a. This is facilitated by the panel c, which moves laterally across the device 402 from its position separating the storage portion and the heating chamber towards the opening created by panel a in the heating chamber 104. As shown in stage IV, panel a then slides vertically downwards and returns to its original position such that the heating chamber 104 does not have an opening and is not open to the exterior. The panel c also moves back laterally across the device to its original position providing separation of the storage portion and the heating chamber. At stage V, the same panel c then slides vertically upwards to allow transfer of the tobacco consumable from the storage portion 106 of the smoking device 402 to the heating chamber 104. It will be appreciated that in its original position, panel c seals the storage portion when the resealable closure of the storage portion is in the closed position and furthermore, is resealable, such that upon return of panel c to its original position, the panel seals the storage portion when the resealable closure of the storage portion is in the closed position. The transfer of tobacco consumable from the storage portion 106 to the heating chamber 104 is shown at stage VI, in which panel d moves laterally across the device towards the heating chamber 104 and pushes a portion of tobacco consumable, the portion corresponding to the capacity of the heating chamber 104, from the storage portion 106 of the device 402 to the heating chamber 104. It will be appreciated that in its original position, panel d may function as a resealable closure of the storage portion being situated toward the first end of the smoking device. Stage VII demonstrates that both panel d and panel c return to their original positions, panel d moving laterally across the device 402 and panel c sliding vertically downwards to once again provide separation of the storage portion 106 of the smoking device 402 and the heating chamber 104. At stage VIII, it can be seen that panel b returns to its original position in the smoking device 402 through lateral movement across the device 402. It will be appreciated that a bias mechanism 134, shown in FIG. 4 as a spring, continually exerts a pressure on the tobacco consumable in the storage portion. Upon movement of panel b to its original position, the bias mechanism 134 propels tobacco consumable into the unoccupied volume of the storage portion 106. It will further be appreciated that other bias mechanisms may be used to achieve the same function in the smoking device. Examples of alternative bias mechanisms include a system comprising a pressing plate for exerting pressure on the tobacco consumable in the storage portion, the pressing plate coupled to a guide and a threaded rod driven by a motor. Stage IX of FIG. 4 shows the mechanical network of component of the smoking device 402 in their original configuration.

It will be appreciated that the operation of the smoking device of FIG. 4 is as described above in relation to FIGS. 1 to 3. It will be further appreciated that where the reference numerals in FIG. 4 are the same as those used in FIGS. 1 to 3, the reference numerals refer to the same features of the smoking device.

Attention is directed to all papers and documents which are filed concurrently with or previous to this specification in connection with this application and which are open to public inspection with this specification, and the contents of all such papers and document are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in the specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

This invention is not restricted to the details of the foregoing embodiment(s). The invention extends to any novel one or any novel combination, of the features disclosed in this specification (including any accompanying claims, abstract and drawings), or to any novel one, or any novel combination, of the steps of any method or process so disclosed.

The invention claimed is:

1. A smoking device comprising a heating chamber for heating a tobacco consumable and a storage portion for storing the tobacco consumable, wherein the storage portion includes a resealable closure through which the tobacco consumable is configured to be loaded into the storage portion or unloaded from the storage portion.

2. The smoking device according to claim 1, wherein the smoking device is elongate and the resealable closure of the storage portion is situated at or toward an end of the device.

3. A smoking device comprising a mouthpiece disposed at a first end of the smoking device, a heating chamber for heating a tobacco consumable and a storage portion for storing the tobacco consumable, wherein the storage portion includes a resealable closure through which the tobacco consumable is configured to be loaded into the storage portion or unloaded from the storage portion, and wherein the heating chamber includes an opening for loading the tobacco consumable into the heating chamber, the opening spaced from the mouthpiece along a housing of the smoking device.

4. The smoking device according to claim 1, wherein the separator is moveable.

5. The smoking device according to claim wherein the storage portion is elongate and the separator is moveable in a longitudinal direction. of the storage portion to alter a volume of the at least first and second storage portions.

6. The smoking device according to claim 1, wherein both of the at least first and second storage portions comprise a resealable closure, the resealable closure of the first storage portion being at or toward a first end of the device and the resealable closure of the second storage portion being at or toward a second end of the device.

7. The smoking device according to claim 1, wherein the resealable closure is rotatably connected to the storage portion such that the resealable closure has an open position and a closed position.

8. A smoking device comprising a heating chamber for heating a tobacco consumable and a storage portion for storing the tobacco consumable, wherein the storage portion includes a resealable closure through which the tobacco consumable is configured to be loaded into the storage portion or unloaded from the storage portion wherein the heating chamber comprises a closure, the closure including an air inlet configured to allow air to enter the heating chamber therethrough during inhalation.

9. The smoking device according to claim 1, wherein the heating chamber comprises an opening and a closure associated therewith.

10. The smoking device according to claim 9, wherein the smoking device is elongate and the resealable closure of the storage portion is situated at or toward an end of the device, and the opening of the heating chamber is situated at or toward the same end of the device as the resealable closure of the storage portion.

11. The smoking device according to claim 1, wherein the storage portion is detachable from the smoking device.

12. The smoking device according to claim 1, wherein a capacity of the storage portion is the same or greater than a capacity of the heating chamber.

13. The smoking device according to claim 1, further comprising a transfer mechanism to transfer, in use, the tobacco consumable from the storage portion to the heating chamber.

14. The smoking device according to claim 13, wherein the transfer mechanism transfers, in use, the tobacco consumable from the storage portion to the heating chamber upon measurement of a predetermined parameter associated with the smoking device.

15. A smoking kit comprising the smoking device according to claim 1 and a tobacco consumable.

16. The smoking device according to claim 6, wherein the heating chamber comprises an opening and a closure associated therewith, and the opening of the heating chamber is situated at or toward the first end of the device.

17. The smoking device according to claim 9, wherein the heating chamber opening and the resealable closure of the storage portion are positioned along an outer housing of the smoking device, the heating chamber opening and the resealable closure being spaced apart from one another along the housing.

* * * * *